US007325797B2

(12) United States Patent
Kloepfer et al.

(10) Patent No.: US 7,325,797 B2
(45) Date of Patent: Feb. 5, 2008

(54) CLAMPING AND SPREADING DEVICE

(75) Inventors: Gerhard Kloepfer, Pleidelsheim (DE); Hans Roesch, Gemmrigheim (DE)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 149 days.

(21) Appl. No.: 11/066,344

(22) Filed: Feb. 24, 2005

(65) Prior Publication Data

US 2005/0200065 A1 Sep. 15, 2005

(30) Foreign Application Priority Data

Mar. 12, 2004 (DE) ..... 10 2004 013 066

(51) Int. Cl.
*B25B 1/00* (2006.01)

(52) U.S. Cl. ..... 269/6; 269/3; 269/166

(58) Field of Classification Search ..... 269/6, 269/3, 32, 228, 147–150, 165–171.5, 170
See application file for complete search history.

(56) References Cited

U.S. PATENT DOCUMENTS 3,096,975 A 7/1963 Irwin
4,185,811 A 1/1980 Long
4,257,584 A 3/1981 Sterling
5,593,147 A 1/1997 Read
5,853,168 A * 12/1998 Drake ..... 269/6
6,152,434 A 11/2000 Gluck
6,575,442 B2 * 6/2003 Klimach et al. ..... 269/6
6,578,837 B1 * 6/2003 Blank et al. ..... 269/6
2005/0200065 A1 * 9/2005 Kloepfer et al. ..... 269/6

FOREIGN PATENT DOCUMENTS

WO 01/56747 8/2001

* cited by examiner

*Primary Examiner*—Lee D. Wilson
(74) *Attorney, Agent, or Firm*—Lipsitz & McAllister, LLC

(57) ABSTRACT

In order to provide a clamping and spreading device with a slide rail which is mounted for displacement and the displacement movement of which can be actuated in a clamping direction with blocking of the displaceability in the opposite direction and the displacement movement of which can be actuated in a spreading direction with blocking of the displaceability in the opposite direction, wherein the direction of displacement can be switched over between clamping direction and spreading direction, which can be produced in a simple manner and can be operated in a simple manner, a movable positioning element is suggested which supports actuating elements for the slide rail, wherein the displacement movement of the slide rail in the clamping direction or in the spreading direction can be actuated as a function of the position of the positioning element.

39 Claims, 4 Drawing Sheets

A
3
3

CLAMPING AND SPREADING DEVICE

The present disclosure relates to the subject matter disclosed in German application No. 10 2004 013 066.3 of Mar. 12, 2004, which is incorporated herein by reference in its entirety and for all purposes.

BACKGROUND OF THE INVENTION

The invention relates to a clamping and spreading device with a slide rail which is mounted for displacement and the displacement movement of which can be actuated in a clamping direction with blocking of the displaceability in the opposite direction and the displacement movement of which can be actuated in a spreading direction with blocking of the displaceability in the opposite direction, wherein the direction of displacement can be switched over between clamping direction and spreading direction.

Such a clamping and spreading device is known, for example, from WO 01/56747 A1. Clamping and spreading devices are also known from U.S. Pat. No. 4,257,584 and U.S. Pat. No. 5,593,147.

SUMMARY OF THE INVENTION

In accordance with the invention, a clamping and spreading device is made available which can be produced in a simple manner and can be operated in a simple manner.

In accordance with the invention a movable positioning element is provided which supports actuating elements for the slide rail, wherein the displacement movement of the slide rail in the clamping direction or in the spreading direction can be actuated as a function of the position of the positioning element.

As a result of the movable and, in particular, displaceable positioning element (which can be designed in one part or several parts), the actuating elements may be positioned such that the slide rail can be displaced in the clamping direction or in the spreading direction. As a result, it is possible for the displacement actuation of the slide rail to be switched over between clamping direction and spreading direction in a simple manner.

It is possible, in particular, to act on the actuating elements via a single gripping lever so that a displacement actuation is possible in the clamping direction and in the spreading direction via a single gripping lever. The gripping lever may be arranged in a simple manner such that a displacement of the slide rail in the clamping direction or spreading direction, depending on the position of the positioning element, is brought about during a pivoting movement in a single direction.

In addition, the movable positioning element makes it possible to arrange a gripping lever as required. In particular, it may be arranged such that the clamping and spreading device has smaller dimensions. It may also be arranged such that the clamping and spreading device can be operated with one hand. For example, it is possible to arrange the gripping lever such that it can be pivoted towards the slide rail for the purpose of its displacement actuation. In this case, it does not project laterally beyond the clamping and spreading device. As a result, a simple handling capability of the clamping and spreading device may also be achieved.

The assembly of the clamping and spreading device during its production is simplified via the movable positioning element. The number of components may be kept small. For example, it is possible to provide only two actuating elements which can also act as blocking elements for the displaceability in the opposite direction to the direction of displacement associated with an actuating element.

The positioning element is favorably displaceable in the direction of displacement of the slide rail. A displacement guidance may then be made available via the slide rail so that no separate displacement guidance need be formed within a housing.

For the same reason, it is favorable when the positioning element is mounted on the slide rail and, in particular, is displaceable on the slide rail.

It is particularly advantageous when a first position is provided for the positioning element, in which the displacement of the slide rail in the spreading direction can be actuated. The first position is a distinguished position. In this first position, the positioning element is arranged such that only a displacement actuation of the slide rail in the spreading direction is possible. The displaceability of the slide rail in the opposite direction (the clamping direction) is preferably blocked via the positioning of the positioning element in the first position.

It is favorable when the first position can be fixed, for example, by way of locking. As a result, the first position is defined as a distinguished position and this can be set for an operator in a defined manner.

For the same reason, it is favorable when a second position is provided as a distinguished position for the positioning element and in this position the displacement of the slide rail in the clamping direction can be actuated.

It is likewise favorable when the second position can be fixed.

It is particularly favorable when a movement of the positioning element can be actuated via a changeover device for switching the direction of movement of the slide rail. The positioning element may also be part of the changeover device. When a changeover takes place, the positioning element is moved, namely into a position (in particular, the first position or the second position), in which the slide rail is displaceable only in the spreading direction or only in the clamping direction.

It is favorable when the positioning element can be brought via the changeover device into a first position, in which the slide rail is displaceable in the spreading direction, and can be brought into a second position, in which the slide rail is displaceable in the clamping direction. As a result, the direction of displacement may be changed over via the positioning element.

An inventive clamping and spreading device may be produced in a simple manner when the changeover device has a mechanical switch which is coupled to the positioning element. The positioning element may be moved and, in particular, displaced via this mechanical switch. For example, a rotary switch may be provided which is arranged and designed and is coupled to the positioning element such that a rotational movement of the mechanical switch can be converted into a translational movement of the positioning element.

It is particularly advantageous when an actuating element is designed as a blocking element for blocking the displaceability of the slide rail in an opposite direction to the direction of displacement associated with the actuating element. As a result, the number of parts for the displacement mechanism and blocking mechanism of the inventive clamping and spreading device may be minimized. In addition, the corresponding device may also be of a compact and space-saving design as a result since no separate blocking elements need be provided in addition to the actuating elements.

It is favorable when at least one contact surface is made available in order to keep a blocking element in a blocking position. As a result of such a contact surface, a blocking element may, for example, be kept in a tilted position which allows the displacement of the slide rail in the enabled direction and blocks the displaceability in the opposite direction. The blocking element may be kept in its blocking position (titled position) via the contact surface.

It is favorable when at least one return spring is associated with an actuating element. When a force is exerted on the actuating element, such a return spring is then, for example, compressed. Once the exertion of force has terminated, the actuating element is returned to its original position so that a renewed actuating procedure can be carried out. This also makes it possible for a pivoting lever (gripping lever) to be pivoted back into its original position.

The at least one return spring associated with the actuating element is favorably arranged on the positioning element, wherein the positioning element is advantageously designed as a spring cage. The movable positioning element, in its distinguished position, then provides for a resetting of the respective actuating element.

In one embodiment, the positioning element supports a first actuating element for the actuation of the displacement movement of the slide rail in the clamping direction.

It is then favorable when the first actuating element acts as a blocking element for the displaceability in the spreading direction.

In addition, the positioning element supports a second actuating element for the actuation of the displacement guidance of the slide rail in the spreading direction. It is likewise favorable when the second actuating element acts as a blocking element for the displaceability of the slide rail in the clamping direction. The number of components required may be kept small as a result. Again, the inventive clamping and spreading device may be of a compact construction and be simple to produce as a result.

At least one spring is favorably arranged between the first actuating element and the second actuating element. A spring is preferably arranged between the first actuating element and the second actuating element with respect to both sides of the slide rail. In addition, a spacer element may be arranged between the two actuating elements. As a result of the springs, the two actuating elements can be supported on one another, wherein a resetting is provided for. The spacer element can also serve as a spring guide which simplifies the assembly of the positioning element as a spring cage with actuating elements.

At least one gripping lever is favorably provided for the actuation of the displacement of the slide rail. This gripping lever, which can be designed in one piece or several parts, acts on the corresponding actuating elements in order to cant these with the slide rail and then provide for a forward thrust.

An actuating element can, in particular, be tilted and displaced via the at least one gripping lever in order to be able to take along the slide rail for the purpose of displacement.

It is particularly advantageous when a single gripping lever is provided which is arranged and designed such that it acts on a first actuating element for the displacement of the slide rail in clamping direction or on a second actuating element for the displacement of the slide rail in the spreading direction depending on the position of the positioning element. As a result of the movable positioning element, a single gripping lever is sufficient to actuate the displacement of the slide rail in the clamping direction and in the spreading direction.

It is possible to change over between these two directions via movement and, in particular, displacement of the positioning element. The inventive clamping and spreading device may then be of a compact construction. As only a single gripping lever needs to be provided, the space requirements are kept small. The gripping lever may, again, be arranged such that the inventive clamping and spreading device can be operated in a simple manner and, in particular, can be operated with one hand. In addition, the production is also simplified as a result.

The first actuating element and the second actuating element can, in particular, be tilted (and displaced) in opposite directions via a gripping lever depending on the position of the positioning element. As a result of the tilting in opposite directions and corresponding canting and movement, the slide rail can be taken along in one direction or in the other direction (opposite direction) via the respective actuating element.

It is advantageous when the at least one gripping lever is pivotally mounted on a housing via a bearing formed by a stub shaft and stub shaft receiver (receptacle). The gripping lever may be mounted proceeding from an (inner) surface of the housing so that no shaft need pass through the housing. No corresponding space for such a shaft need then be made available. As a result, the assembly is simplified and a compact construction may be achieved.

It is favorably provided for the bearing formed by the stub shaft and stub shaft receiver to be arranged above the positioning element. As a result, corresponding lever flanges of the gripping lever may then engage on the actuating elements in a simple manner in order to, again, be able to displace the slide rail by means of the actuating elements as a result.

It is provided for the at least one gripping lever to be arranged and designed such that during its pivoting towards the slide rail a displacement of the slide rail can be actuated. This results in a simple operability. In particular, one-handed operations can be realized when a corresponding counter-gripping element is provided.

In this connection, it is favorable when the at least one gripping lever is seated at an acute angle in relation to the slide rail when it is not actuated. This angle is, for example, in the order of magnitude of 40°. An operator can then grip the gripping lever and a counter-gripping element with one hand and pivot the gripping lever in the direction of the slide rail (in the direction of the counter-gripping element) in order to actuate the displacement of the slide rail. The direction of displacement of the slide rail is controlled by the positioning of the positioning element.

It is particularly advantageous when a counter-gripping element is provided for the at least one gripping lever for the purpose of one-handed operations.

It is favorable in this connection when the counter-gripping element is oriented along the slide rail. As a result, the dimensions of the inventive clamping and spreading device may be kept small and a simple operability is made possible.

The slide rail is, in particular, mounted for displacement in the counter-gripping element. An additional displacement bearing for the slide rail may then be made available via the counter-gripping element in order to be able to mount this as far as possible free from clearance.

In one advantageous embodiment, a release element (release lever) is provided, via which a blocking element can be brought into a non-blocking position. The release element may be designed in one part or several parts. In practice, the slide rail must, in many cases, be displaced over longer distances and such a displacement via the actuating elements is too time-consuming. The release element can engage the respectively acting blocking element directly and this blocking element be released and an operator can than displace the slide rail by hand. In addition, a clamping position of the device (with a clamped workpiece) can be released.

The release element is designed, in particular, such that it acts on the respective blocking element dependent on the position of the positioning element. As a result, it is possible for the release element to act just on the relevant blocking element. An operator can then release the slide rail irrespective of whether any actuation of the slide rail is set in clamping direction or in spreading direction.

In a constructionally simple embodiment, the release element is arranged so as to be pivotable. The release element is designed, in particular, as a release lever. As a result of pivoting, it can act on a blocking element such that its blocking effect is terminated.

For example, the release element is mounted on a gripping lever for actuating the pivoting of the slide rail. As a result, a corresponding pivot bearing is formed in a simple and space-saving manner.

The release element is arranged and designed, in particular, such that a pivoting direction for the purpose of releasing is independent of the position of the positioning element. As a result, the operation is simplified.

A housing is advantageously provided, in which the slide rail is mounted for displacement. The housing can accommodate the displacement mechanism and blocking mechanism for the slide rail. This is accommodated in the housing in a protected manner.

The positioning element is favorably guided in the housing so that it is protected in its displaceability from external influences.

For example, a housing cover is provided. As a result, the assembly of the inventive clamping and spreading device is simplified during its production.

It is particularly favorable when the housing is designed such that the movable parts for the displacement mechanism can be inserted. The corresponding contact surfaces and receiving areas are preferably produced integrally in the corresponding housing part. The mechanism can then be inserted without any additional elements, such as pin shafts or the like, needing to be provided. The assembly is simplified to a great extent as a result. The housing may then be closed via a housing cover which is fixed to the remainder of the housing.

A contact element for workpieces is favorably connected to the housing. This contact element can be a separate part which is connected to the housing. It may, however, also be a contact element formed in one piece on the housing.

Furthermore, a contact element for workpieces is connected to the slide rail. This contact element is, in particular, seated securely on the slide rail. Workpieces can then be clamped between the two contact elements when these are moved towards one another. When the contact elements are moved away from one another, corresponding spreading forces may be exerted on workpieces.

The following description of a preferred embodiment serves to explain the invention in greater detail in conjunction with the drawings.

DETAILED DESCRIPTION OF THE INVENTION

Figures 1, 2:
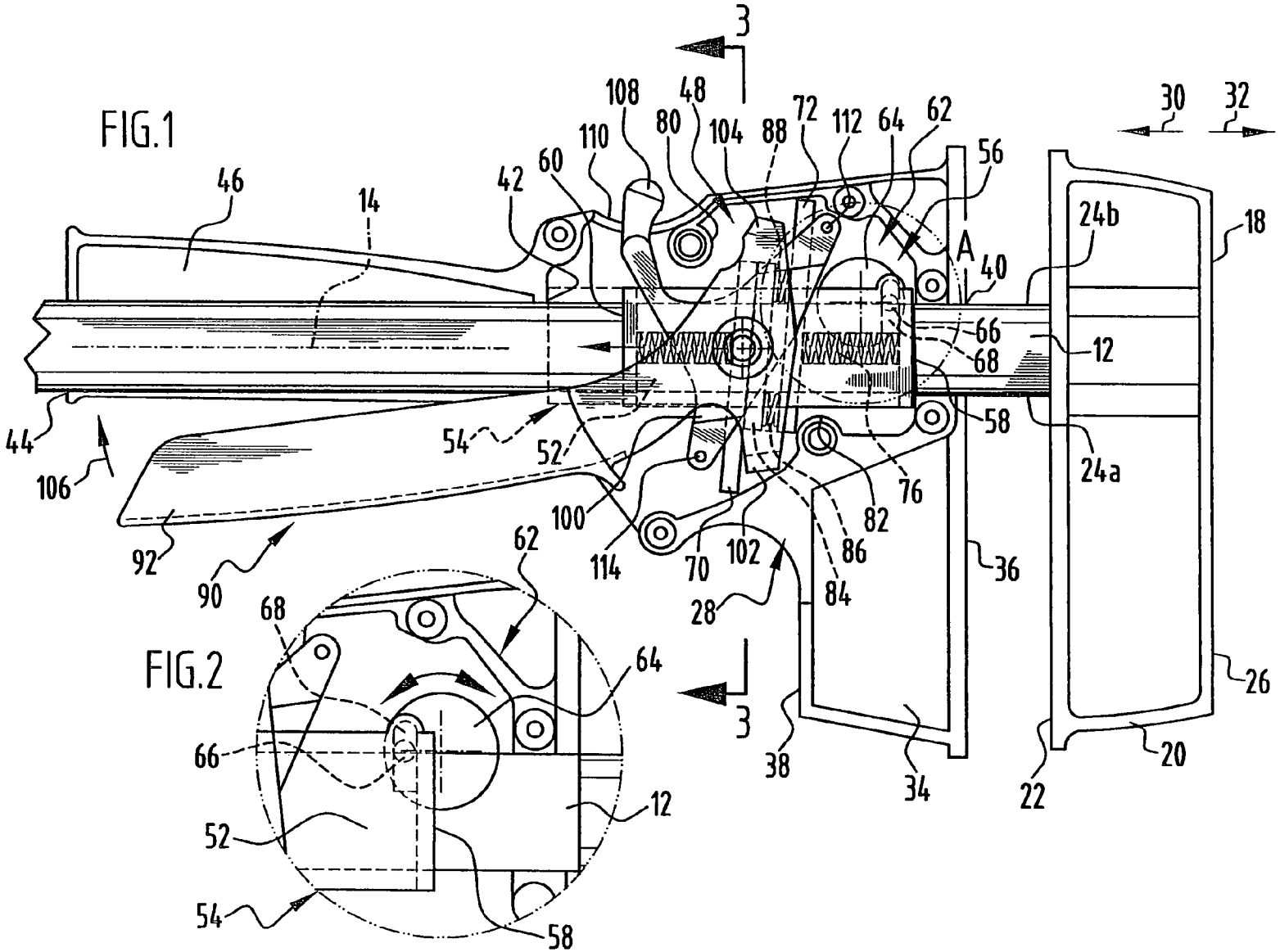
FIG. 1 shows a partial sectional view of one embodiment of an inventive clamping and spreading device.
FIG. 2 shows an enlarged illustration of the area A according to FIG. 1.
Figure 3:
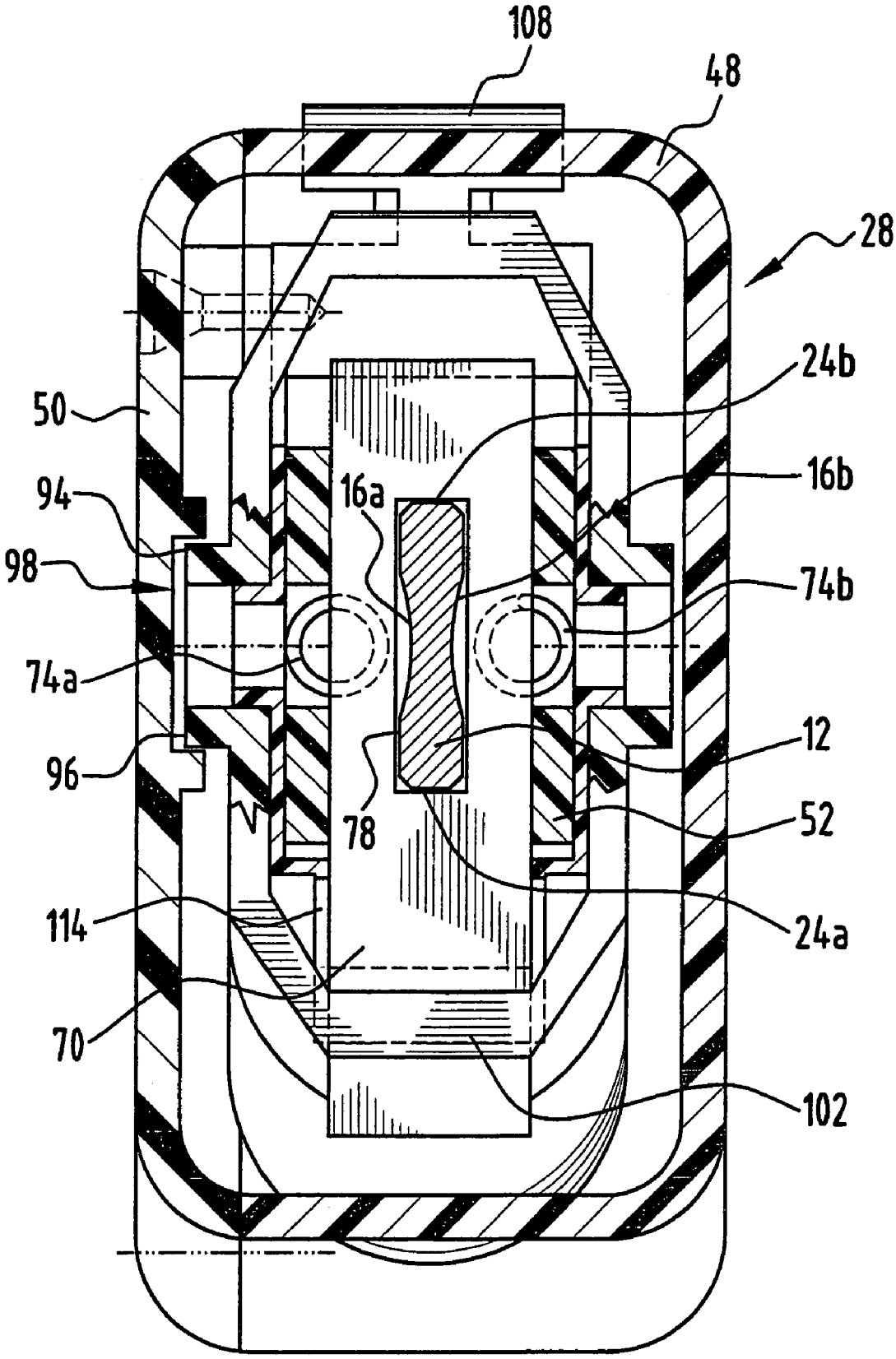
FIG. 3 shows a sectional view of the clamping and spreading device according to FIG. 1 along line 3-3.

One embodiment of an inventive clamping and spreading device, which is designed, in particular, as a one-handed clamp, is shown in FIG. 1 in a partial sectional view and designated as a whole as 10. The clamping and spreading device 10 has a slide rail 12 which extends in a longitudinal direction 14. The slide rail 12 is profiled (FIG. 3). It has indentations 16*a*, 16*b* in opposite long sides. The slide rail 12 is preferably produced from a metallic material.

A contact element 20 ("jaw") for workpieces is arranged in the area of one end 18 of the slide rail 12. This contact element 20 is, in particular, securely connected to the slide rail 12. It may be provided for the contact element 20 to be releasably fixed on the slide rail 12 or securely fixed on it. The contact element 20 may be formed in one piece on the slide rail 12 or it may be a separate element which is subsequently fixed to the slide rail 12. The contact element 20 is produced, for example, from a plastic material.

The contact element 20 has a first contact surface 22. This first contact surface 22 is preferably flat. In relation to opposite, short sides 24*a*, 24*b* of the slide rail, the contact surface 22 projects beyond these so that a workpiece can be placed above or below the slide rail 12.

The contact element 20 has an additional, second contact surface 26 which is located opposite the first contact surface 22. The second contact surface 26 is, in this respect, an outer surface. This second contact surface 26 is preferably flat.

The slide rail 12 is mounted for displacement in a housing 28 and, in particular, is mounted for sliding displacement. The slide rail 12 is displaceable relative to this housing 28 parallel to its longitudinal direction in a clamping direction 30 and in a spreading direction 32. The spreading direction 32 is the opposite direction to the clamping direction 30 or rather the clamping direction 30 is the opposite direction to the spreading direction 32.

A contact element 34 ("jaw") is connected to the housing 28 and has a first contact surface 36 for workpieces. The first contact surface 36 of the contact element 34 points towards the first contact surface 22 of the contact element 20 so that one or more workpieces can be clamped between the contact surfaces 22, 36. The first contact surface 36 is designed, in particular, so as to be essentially flat and extends beyond both sides 24*a*, 24*b* of the slide, rail 12. The first contact surface 36 is, in its shape, essentially of the same design as the first contact surface 22 of the contact element 20.

The contact element 34 has, in addition, a second contact surface 38 which is located opposite the first contact surface 36. This second contact surface 38 is, in particular, of an essentially flat design. A spreading force may be exerted on the corresponding workpieces during displacement of the slide rail 12 in the spreading direction 32 via abutment of the second contact surface 26 of the contact element 20 on a workpiece and abutment of the second contact surface 38 of the contact element 34 on a workpiece.

The second contact element 34 can be connected to the housing 28 in one piece. For example, the housing 28 is produced with an integrated contact element 34 consisting of a plastic material. It is, in principle, also possible for the contact element 34 to be a part which is separate from the housing 28 and is fixed to the housing 28 during production.

The contact element 20 is displaceable relative to the contact element 34 (and, therefore, relative to the hosing 28) via the displaceable slide rail 12, wherein the contact element 20 is moved towards the contact element 34 (towards the housing 28) during the displacement of the slide rail in the clamping direction 30 and the contact element 20 is moved away from the contact element 34 (from the housing 28) during displacement of the slide rail in the spreading direction 32.

The housing 28 has bearing points 40, 42 and 44 which are in flush alignment for the displaceable mounting of the slide rail 12. The slide rail 12 passes through these bearing points 40, 42, 44 and is slidingly guided. The bearing points 40, 42, 44 have dimensions which are adapted to the dimensions of the slide rail 12 such that the slide rail 12 is held on the housing 28 essentially free from clearance and is, in this respect, guided on the housing 28 for sliding displacement.

The bearing point 40 is formed, for example, by a recess in the contact element 34. The bearing point 44 is formed by a recess in a counter-gripping element 46. The bearing points 40, 44 are located at or in the vicinity of opposite, outer end surfaces of the housing 28. The bearing point 42 is formed in the housing 28 between the bearing points 40 and 44 in order to provide for an additional support for the slide rail 12.

A displacement mechanism and blocking mechanism for the displacement actuation of the slide rail 12 is accommodated in the housing 28. The housing 28 has for this purpose a shell-like area 48 which accommodates the corresponding parts. This shell-like area 48 is closed by a housing cover 50 (FIG. 3).

The housing 28 is preferably designed such that the displacement mechanism and blocking mechanism for the slide rail 12 can be positioned in the housing 28 without additional fastening screws needing to be provided or additional components (such as, for example, contact pins or shafts) needing to be provided.

A positioning element 52 is guided in the housing 28 so as to be movable and, in particular, displaceable, wherein the direction of displacement is parallel to the direction of displacement of the slide rail 12. The positioning element 52 may be displaced in the clamping direction 30 and the spreading direction 32. The positioning element may be designed in one part or several parts.

In the embodiment shown, the positioning element 52 is seated on the slide rail 12 and is guided on this so as to be displaceable. The slide rail 12 therefore makes a guide path available for the positioning element 52 and so no additional guide path need be provided in the housing 28.

The positioning element 52 has two distinguished positions, namely a first position 54, in which the positioning element 52 is displaced the furthest in the clamping direction 30. This first position 54 is indicated in FIG. 1 by dashed lines. In this first position 54, the positioning element 52 is located at or in the vicinity of the bearing point 42.

In a second position 56, which is shown in FIG. 1 by solid lines, the positioning element 52 is displaced in the housing 28 the furthest in the spreading direction 32. In FIG. 2, the positioning element 52 is shown in its first position 54. One end 58 of the positioning element 52, which faces the contact element 20, is then located closest to the bearing point 40. An end 60 of the positioning element 52 located opposite the end 58 has the greatest distance to the bearing point 42 in the second position 56. Accordingly, the end 58 has the greatest distance to the bearing point 40 in the first position 54 and the end 60 has the smallest distance to the bearing point 42.

The displacement movement of the positioning element 52 on the slide rail 12 can be actuated via a changeover device 62, wherein, as will be described in greater detail in the following, it is possible to switch over via the changeover device 62 between a displacement of the slide rail 12 in the spreading direction 32 with blocking of the displaceability in the opposite direction 30 and a displaceability of the slide rail 12 in the clamping direction 30 with blocking of the displaceability in the opposite direction 32. The changeover is brought about by way of positioning of the positioning element 52 in the positions 54 and 56.

The changeover device 62 comprises, in the embodiment shown, a rotary switch 64 (FIGS. 1 and 2) which is mounted for rotation in the housing 28. This rotary switch 64 has a pin 66 which is arranged eccentrically and dips into a recess 68 of the positioning element 52. The recess 68 is oriented transversely and, in particular, at right angles to the longitudinal direction 14 of the slide rail 12 (and, therefore, transversely to the directions 30 and 32).

A rotational movement of the rotary switch 64 may be converted into a linear displacement movement of the positioning element 52 by means of the engagement of the eccentrically arranged pin 66 in the recess 68 in order to be able to displace, in particular, the positioning element 52 from its first position 54 into the second position 56 and proceeding from the second position 56 to be able to bring the positioning element 52 into the first position 54. In the first position 54 (FIG. 2), for example, the pin 66 is located further away from the bearing point 40 than in the second position 56 (FIG. 1) of the positioning element 52.

The rotary switch 64 is preferably designed in relation to the recess 68 such that the first position 54 and the second position 56 are distinguished positions which can be fixed. For example, the rotary switch 64 can be locked for this purpose when the first position 54 is reached or when the second position 56 is reached. It may also be provided for the rotary switch 64 to be designed in relation to the recess 68 such that it can no longer be turned further when the first position 54 is reached, i.e., that proceeding from the first position 54 only a rotational movement in an opposite direction is possible in order to bring the positioning element 52 out of the first position 54. In a similar way, it is then advantageous when it is provided for it to no longer be possible to turn the rotary switch 64 further when, proceeding from the first position 54, the second position 56 is reached. In this case, only a rotation in the opposite direction is possible in order to be able to bring the positioning element 52 out of the second position 56 into the first position 54.

The positioning element 52 supports a first actuating element 70 and a second actuating element 72. A displacement actuation of the slide rail 12 in the clamping direction 30 is made possible via the first actuating element 70 and a displacement actuation of the slide rail 12 in the spreading direction 32 is made possible via the second actuating element 72.

In this respect, a pair of return springs 74*a*, 74*b* acts on the first actuating element 70, wherein the return springs 74*a*, 74*b* are arranged on opposite sides of the positioning element 52 (FIG. 3). The return springs 74*a*, 74*b* are thereby supported on an area of the positioning element 52 which is located at or in the vicinity of the end 60.

Accordingly, a pair of return springs is provided for the second actuating element 72, wherein in FIG. 1 only one return spring 76 of this pair is visible.

The actuating elements 70, 72 are preferably metallic parts which have a respective recess 78 (FIG. 3), with which they are arranged on the slide 12 at the positioning element 52. When the positioning element 52 is moved, the actuating elements 70, 72 are displaced with it.

The actuating elements 70, 72 are, in particular, of a plate-like design. They are tilted or can be tilted in relation to the slide rail 12 and they can be canted with the slide rail 12. The movement of the slide rail 12 is brought about in a direction of displacement and blocked in the opposite direction by the actuating elements 70, 72 depending on the direction of canting and the action of a force. This will be explained in greater detail in the following.

The first actuating element 70 serves for the displacement actuation of the slide rail 12 in the clamping direction 30. The second actuating element 72 serves for the displacement actuation of the slide rail 12 in the spreading direction 32. Whether it is the actuating element 70 which is acting on the slide rail 12 or the actuating element 72 which is acting on the slide rail 12 is controlled by the position of the positioning element 52. In the first position 54, the second actuating element 72 may be tilted such that the slide rail 12 is taken along via the corresponding canting and movement of the actuating element 72 and displaced in the spreading direction 32. In the second position 56 of the positioning element 52, the first actuating element 70 may be tilted and canted with the slide rail and moved such that the slide rail 12 is taken along in the clamping direction 30.

The first actuating element 70 is a blocking element which blocks the displaceability of the slide rail 12 in the clamping direction 30 and enables the displaceability in the spreading direction 32 when the positioning element 52 is in its first position 54. Accordingly, the second actuating element 72 is a blocking element which blocks the displaceability of the slide rail 12 in the spreading direction 32 and enables the displaceability in the clamping direction 30 when the positioning element 52 is in the second position 56.

So that the first actuating element 70 can act as a blocking element, a contact surface 80 is made available in the housing 28 and the first actuating element 70 can abut on this surface in the first position 54 of the positioning element 52 in order, in this way, to provide for a tilting of the actuating element 70 which blocks any displaceability of the slide rail 12 in the clamping direction 30.

Accordingly, a contact surface 82 is made available in the housing 28 for the second actuating element 72 when this second actuating element 72 acts as a blocking element when the positioning element 52 is in the second position 56. The second actuating element 72 can abut on this contact surface 82 in order to make such a tilting available which blocks any displaceability of the slide rail 12 in the spreading direction 32 (and, in this respect, allows the displacement of the slide rail 12 in the clamping direction 30).

In order to actuate the displacement of the slide rail 12 in opposite directions 30, 32, the actuating elements 70, 72 must be tilted in opposite directions.

Consequently, the contact surfaces 80, 82 are located on (diagonally) opposite sides in the housing 28 in relation to the slide rail 12. The contact surfaces 80, 82 may be integrally formed during the production of the housing 28.

The two actuating elements 70, 72 are arranged on the positioning element 52 so as to be spaced. A spacer member 84 is seated on the positioning element 52 between these two actuating elements 70 and 72.

The two actuating elements 70, 72 are, again, supported on one another via a first spring 86 and a second spring 88, wherein the springs 86, 88 are arranged on opposite sides with respect to the slide rail 12. The spacer member 84 has corresponding recesses, through which the springs 86, 88 pass. When a force is exerted on one of the actuating elements 70, 72, the springs 86, 88 allow a relative tiltability of these elements in relation to one another with a restoring action when the exertion of force is terminated.

A gripping lever 90 as gripping element is provided with a handle part 92 for acting on the actuating elements 70, 72. The gripping element 90 is mounted on the housing 28 so as to be pivotable. For this purpose, the gripping element 90 has a stub shaft 94 which is located in a stub shaft receiving means 96 which is formed, in particular, in one piece on the housing cover 50 so that a bearing 98 is formed from the stub shaft and stub shaft receiving means. As a result of this mounting, no shaft need be provided which passes through the housing 28. The bearing 98 is arranged above the positioning element 52 with respect to a direction extending from a housing interior outwards (transversely to the slide rail 12).

The gripping element 90 is designed such that it either acts on the first actuating element 70 or acts on the second actuating element 72, depending on the position of the positioning element 52, in order to actuate either a displacement in the clamping direction 30 (second position 56 of the positioning element 52) or a displacement in the spreading direction 32 (first position 54 of the positioning element 52). For this purpose, the gripping element 90 has, in an area 100 of the gripping element 90 arranged within the housing 28, a first flange 102 which can act on the first actuating element 70 in order to tilt this in the direction of the bearing point 42 and to move it in the spreading direction 32 and, therefore, to bring about the displacement of the slide rail 12 in the clamping direction 30; in addition, it has a second flange 104 which can act on the second actuating element 72 in order to tilt this in the direction of the bearing point 40 and to move it in the clamping direction 30 and, therefore, to bring about a displacement of the slide rail 12 in the spreading direction 32. The second flange 104 is arranged such that it acts on the actuating element 72 facing the side 24*b* of the slide rail 12 and, in this respect, acts on a side of the second actuating element 72 which faces away from the contact surface 36. The first flange 102 is arranged on the gripping element 90 such that it acts on the first actuating element 70 in an area which faces the side 24*a* of the slide rail 12. Furthermore, the first flange 102 acts on an area of the first actuating element 70 which faces the contact surface 36. As a result, a displacement in the clamping direction 30 or in the opposite direction 32 may be achieved due to a pivoting movement of the gripping element 90 in a pivoting direction 106, depending on the position of the positioning element 52. Whether the gripping element 90 acts with its first flange 102 on the first actuating element 70 or acts with its second flange 104 on the second actuating element 72 depends, again, on the displacement position of the positioning element 52. In its second position 56, the gripping element 90 acts on the first actuating element 70 whereas in the first position 54 of the positioning element 52 the second flange 104 acts on the second actuating element 72.

It may be provided for the gripping element 90 to be designed in one piece with the handle part 92, the area 100 and the flanges 102 and 104 as well as the stub shaft 94 and be produced, in particular, from a plastic material.

The handle part 92 of the gripping element 90 is designed such that it can be gripped by a user with his hand, either with the fingers or the palm of the hand. In a non-pivoted position, the handle part 92 is arranged in the embodiment shown at an acute angle in relation to the longitudinal direction 14 of the slide rail 12. This angle can, for example, be in the order of magnitude of 40°. As a result of a pivoting movement in the pivoting direction 106 towards the slide rail 12, the respective actuating element 70, 72, which is selected via the position of the positioning element 52, can be acted upon with a force.

The counter-gripping element 46, which is designed, in particular, in one piece with the housing 28, is a counter-gripping element for the handle part 92 of the gripping element 90. The angular position of the handle part 92 is such that a user can grip the counter-gripping element 46 and the handle part 92 with one hand so that the inventive clamping and spreading device 10 can be actuated with one hand.

Furthermore, a release element 108 is provided which is arranged in the housing 28 so as to be pivotable. For example, it is seated on the gripping element 90 so as to be pivotable. For this purpose, a corresponding pivot bearing is provided. A user can have access to the release element and move it via a recess 110 in the housing 28.

The release element 108 has a first flange 112, with which it can act on the second actuating element 72, namely on a side of the actuating element 72 which faces the contact surface 36. Furthermore, the release element 108 has a second flange 114, with which it can act on the first actuating element 70, namely on a side which faces away from the contact surface 36. The first flange 112 of the release element 108 is located opposite the second flange 104 of the gripping element 90. As a result of the release element, the second actuating element 72 can be released from a tilting position. The same applies for the first actuating element 70 via the flange 114. As a result of the release element, a blocking position of the corresponding actuating element 70 or 72 can be terminated, when this is in a blocking position, in order to be able to displace the slide rail 12 "by hand" or in order to be able to release a clamping position or spreading position with respect to workpieces.

If the positioning element 52 is, for example, in the first position 54 and, therefore, the first actuating element 70 in its blocking position, the actuating element 70 can be tilted in the direction of the contact surface 36 via the release element with the second flange 114 in order to terminate the blocking.

If the positioning element 52 is in the second position 56, in which the second actuating element 72 acts as a blocking element, a movement of the second actuating element 72 away from the contact surface 36 can be brought about via the release element with the first flange 112 in order to terminate the canting and, therefore, terminate the blocking.

The release element 108 is designed, in particular, in one piece. The flanges 112, 114 are located on opposite sides with respect to the slide rail 12. As a result, the slide rail can be released by way of a pivoting movement in one direction irrespective of whether the positioning element 52 is in its first position 54 or in its second position 56.

Figure 4:
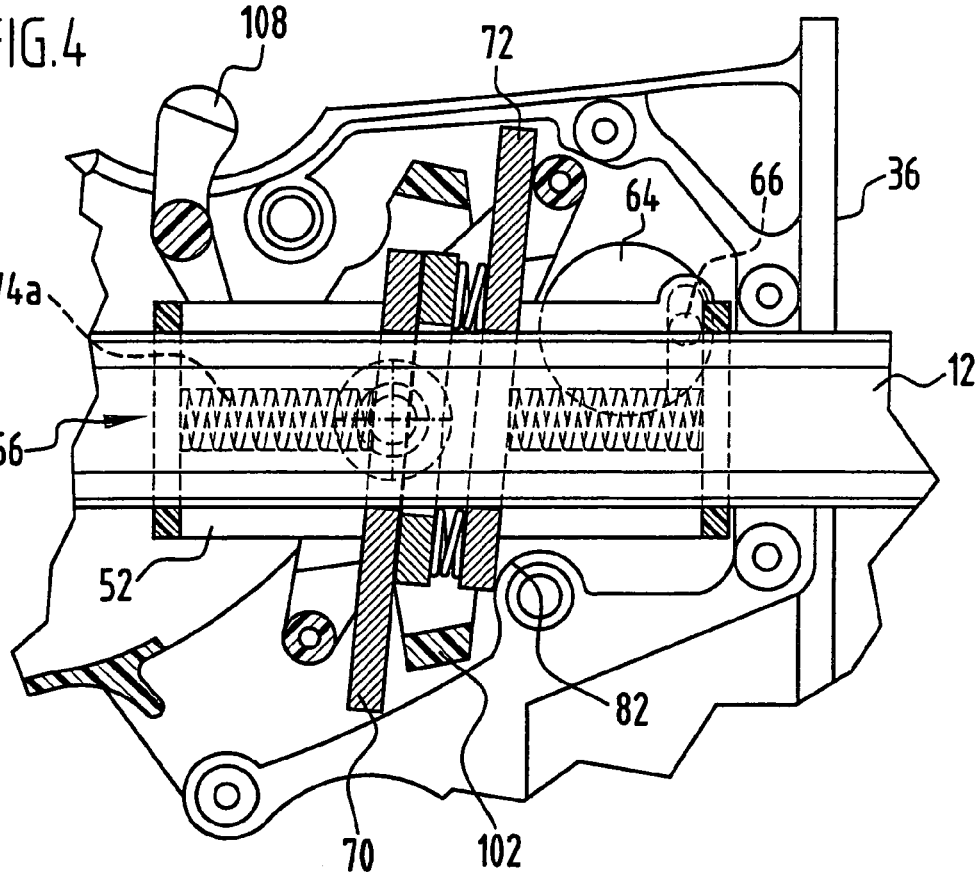
FIG. 4 shows a partial sectional view of mechanical elements for moving a slide rail of the clamping and spreading device according to FIG. 1 when a gripping lever is not pivoted.

The mode of operation of the inventive clamping and spreading device will be explained on the basis of FIGS. 4 to 6:

The rotary switch 64 of the changeover device 52 is in such a position that the positioning element 52 is in its second position 56 (FIG. 4). The second actuating element 72 abuts on the associated contact surface 82 and is tilted in relation to the slide rail 12. As a result, the displaceability of the slide rail 12 in the spreading direction 32 is blocked. The first actuating element 70 is in such a position that displaceability in the clamping direction 30 is enabled. In principle, the slide rail 12 can be displaced in the clamping direction 30 by pressing it in the clamping direction 30. In the second position 56 of the positioning element 52, the gripping element 90 can act on the actuating element 70 with the first flange 102 in order to provide for the slide rail 12 to be taken along in the clamping direction 30.

Figure 5:
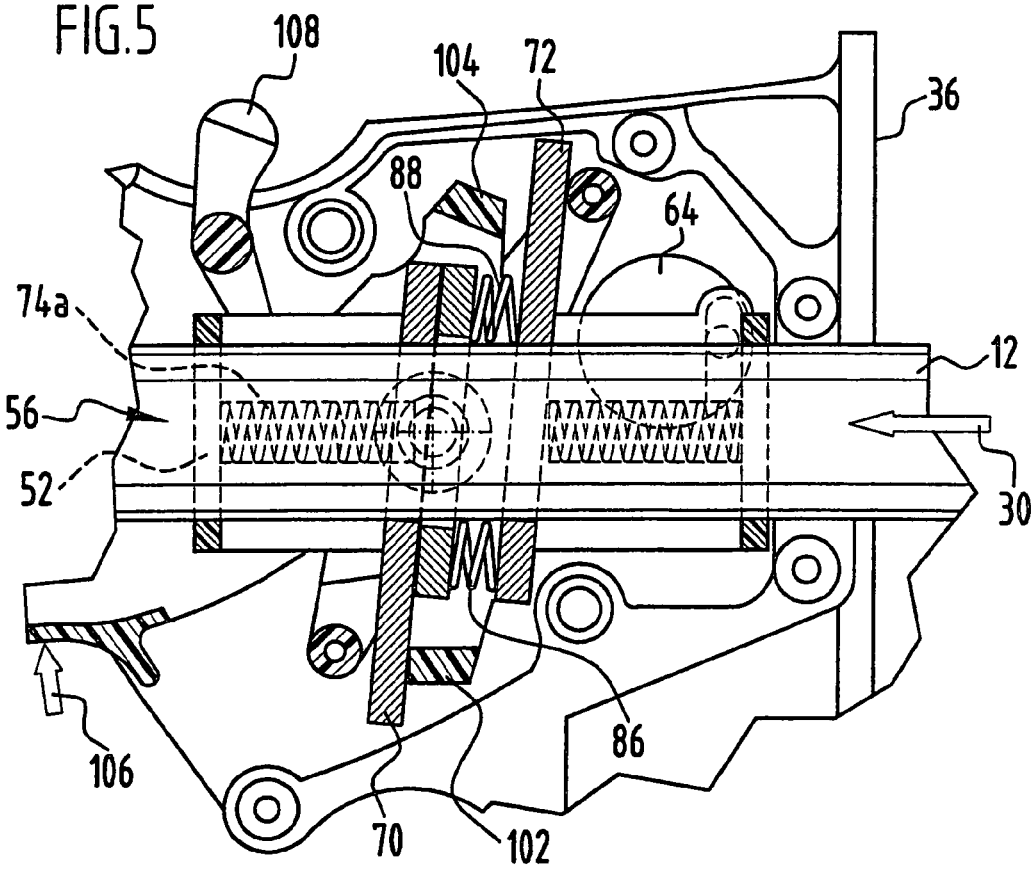
FIG. 5 shows the same view as FIG. 4 depicting a moment during the pivoting of a gripping lever and FIG. 6 shows the same view as FIGS. 4 and 5 depicting a moment during the pivoting movement of a release element.

In FIG. 5, a position is shown, in which the gripping element 90 is pivoted in the direction of the slide rail 12 in relation to an initial position. The first flange 102 of the gripping element 90 acts on the first actuating element 70 and tilts and moves it. As a result, the springs 74*a*, 74*b* are compressed. Due to the tilting and movement of the actuating element 70, the slide rail 12 is taken along in the clamping direction 30 (while the actuating element 72 blocks the displaceability in the opposite direction 32). The springs 86, 88 between the two actuating elements 70, 72 see to it that a tilting or canting of the actuating element 70 is made possible in order to take along the slide rail 12.

When the gripping element 90 is released, the restoring force of the springs 74*a*, 74*b* causes the gripping element 90 to be returned to its initial position. The first actuating element 70 also returns to its initial position shown in FIG. 4, wherein the slide rail 12 is, however, displaced a corresponding distance in the clamping direction 30.

Figure 6:
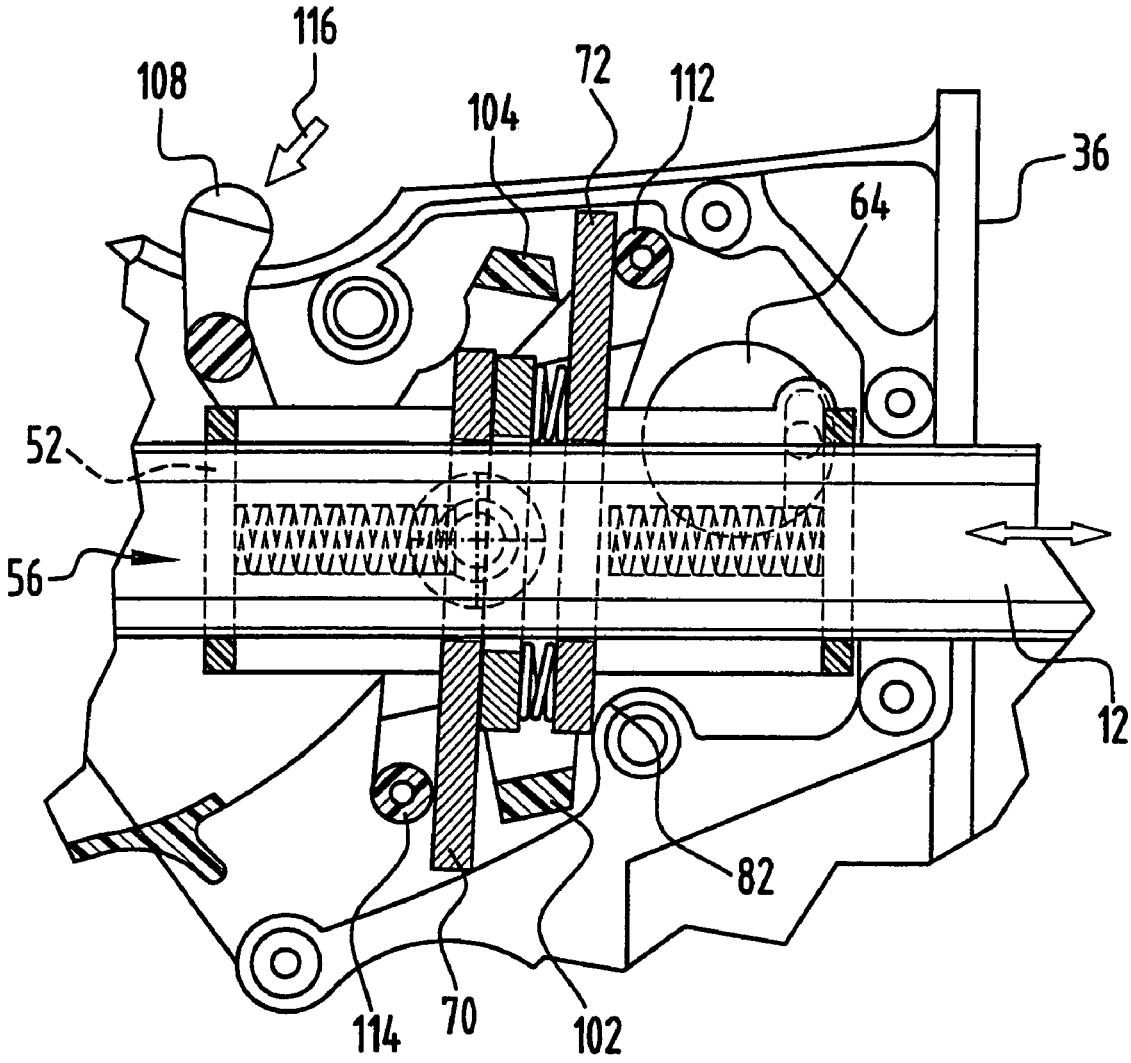

The effect of the release element 108 is shown in FIG. 6. When this, proceeding from the situation according to FIG. 4, is pivoted in the pivoting direction 116, it acts on the actuating element 72 and cancels out its tilting in relation to the slide rail 12 at least partially. As a result, the blocking effect of the actuating element 72 (which is a blocking element in the second position 56 of the positioning element 52) is terminated and the slide rail can be displaced forwards or backwards (in the clamping direction 30 or the spreading direction 32).

As a result of the changeover device 62 with the rotary switch 64, the positioning element 52 can be displaced from the second position 56 into the first position 54 and can be fixed in this position 54, for example, by way of locking. The relations in comparison with the case explained in FIGS. 4 to 6 are reversed insofar as the first actuating element 70 now acts as a blocking element and the second actuating element 72 can be acted upon via the gripping element 90 for the purpose of displacement actuation. The blocking action of the first actuating element 70 can be terminated via the release element 108. The mode of operation is, in principle, the same as that described above on the basis of the second position 56.

The inventive clamping and spreading device 10 may be produced in a simple manner. The number of parts required may be kept small. The displacement and blocking mechanism may be mounted in a simple manner. As a result of the positioning element 52 which is designed, in particular, as a spring cage, it is possible to switch over between a spreading procedure or a clamping procedure in that the positioning element 52 is positioned accordingly in the first position 54 or in the second position 56. It is possible to switch over in a simple manner between these positions 54 and 56 as a result of the displacement on the slide rail 12.

Either a spreading procedure or a clamping procedure may be carried out with a single gripping element 90 (depending on the position of the positioning element 52). The slide rail 12 may be displaced either in the clamping direction 30 or in the spreading direction 32 as a result of a single gripping element 90 with a single direction of pivoting actuation.

The arrangement of the gripping element 90 in relation to the slide rail can, in principle, be selected as required so that an optimized ergonomic configuration is possible. In particular, a counter-gripping element (the counter-gripping element 46) may be aligned along the slide rail 12. As a result, it is, again, possible to mount the slide rail 12 in the counter-gripping element 46 for its sliding displaceability.

The invention claimed is:

1. Clamping and spreading device, comprising:

a first jaw;

a slide rail mounted for displacement and carrying a second jaw;

a movable positioning element;

actuating elements for the slide rail, the actuating elements being supported by said positioning element;

said positioning element in a first position positioning said actuating elements to allow the displacement movement of said slide rail in a clamping direction, where the jaws move together, while blocking the displaceability in a spreading direction where the jaws move apart;

said positioning element in a second position positioning said actuating elements to allow the displacement movement of said slide rail in said spreading direction while blocking the displaceability in the clamping direction; and a changeover device comprising a mechanical switch coupled to the positioning element for moving the positioning element to switch the direction of displacement of said slide rail between the clamping direction and the spreading direction.

2. Clamping and spreading device as defined in claim 1, wherein the positioning element is displaceable in the direction of displacement of the slide rail.

3. Clamping and spreading device as defined in claim 1, wherein the positioning element is mounted on the slide rail.

4. Clamping and spreading device as defined in claim 1, wherein the positioning element is displaceable on the slide rail.

5. Clamping and spreading device as defined in claim 1, wherein the first position is adapted to be fixed.

6. Clamping and spreading device as defined in claim 1, wherein the second position is adapted to be fixed.

7. Clamping and spreading device as defined in claim 1, wherein at least one of said actuating elements comprises a blocking element for blocking the displaceability of said slide rail in a direction opposite to the direction of displacement associated with the actuating element.

8. Clamping and spreading device as defined in claim 7, wherein at least one contact surface is made available in order to keep said blocking element in a blocking position.

9. Clamping and spreading device as defined in claim 1, wherein at least one return spring is associated with at least one of said actuating elements.

10. Clamping and spreading device as defined in claim 9, wherein the at least one return spring associated with the at least one actuating element is arranged on the positioning element.

11. Clamping and spreading device as defined in claim 10, wherein the positioning element comprises a spring cage.

12. Clamping and spreading device as defined in claim 1, wherein the positioning element supports a first actuating element for actuating the displacement movement of the slide rail in the clamping direction.

13. Clamping and spreading device as defined in claim 12, wherein the first actuating element acts as a blocking element for the displaceability of the slide rail in the spreading direction.

14. Clamping and spreading device as defined in claim 12, wherein the positioning element supports a second actuating element for actuating the displacement movement of the slide rail in the spreading direction.

15. Clamping and spreading device as defined in claim 14, wherein the second actuating element acts as a blocking element for the displacement of the slide rail in the clamping direction.

16. Clamping and spreading device as defined in claim 14, wherein at least one spring is arranged between the first actuating element and the second actuating element.

17. Clamping and spreading device as defined in claim 16, wherein a spring is arranged between the first actuating element and the second actuating element with respect to both sides of the slide rail.

18. Clamping and spreading device as defined in claim 1, wherein at least one gripping lever is provided for actuating the displacement of the slide rail.

19. Clamping and spreading device as defined in claim 18, wherein an actuating element is adapted to be tilted via the at least one gripping lever.

20. Clamping and spreading device as defined in claim 18, wherein a single gripping lever is provided, said lever being adapted to act on a first actuating element for the displacement of the slide rail in the clamping direction or on a second actuating element for the displacement of the slide rail in the spreading direction depending on the position of the positioning element.

21. Clamping and spreading device as defined in claim 20, wherein the first actuating element and the second actuating element are adapted to be tilted via the gripping lever in opposite directions relative to the slide rail depending on the position of the positioning element.

22. Clamping and spreading device as defined in claim 18, wherein the at least one gripping lever is pivotally mounted on a housing via a bearing formed by a stub shaft and stub shaft receiver.

23. Clamping and spreading device as defined in claim 22, wherein the bearing formed by the stub shaft and stub shaft receiver is arranged above the positioning element.

24. Clamping and spreading device as defined in claim 18, wherein the at least one gripping lever is arranged and designed such that the slide rail is displaceable during the pivoting of the lever towards the slide rail.

25. Clamping and spreading device as defined in claim 18, wherein the at least one gripping lever is seated at an acute angle in relation to the slide rail when the gripping lever is not actuated.

26. Clamping and spreading device as defined in claim 18, wherein a counter-gripping element is provided for the at least one gripping lever for the purpose of one-handed actuatability.

27. Clamping and spreading device as defined in claim 26, wherein the counter-gripping element is oriented longitudinally in relation to the slide rail.

28. Clamping and spreading device as defined in claim 26, wherein the slide rail is mounted for displacement in the counter-gripping element.

29. Clamping and spreading device as defined in claim 1, wherein a release element is provided, and a blocking element is adapted to be brought into a non-blocking position via said release element.

30. Clamping and spreading device as defined in claim 29, wherein the release element is designed to act on the blocking element dependent on the position of the positioning element.

31. Clamping and spreading device as defined in claim 29, wherein the release element is pivotable.

32. Clamping and spreading device as defined in claim 31, wherein the release element is mounted on a gripping lever for actuating the displacement of the slide rail.

33. Clamping and spreading device as defined in claim 31, wherein the release element is arranged and designed such that a pivoting direction for the purpose of releasing is independent of the position of the positioning element.

34. Clamping and spreading device as defined in claim 1, wherein a housing is provided, the slide rail being mounted for displacement in said housing.

35. Clamping and spreading device as defined in claim 34, wherein the positioning element is guided in the housing.

36. Clamping and spreading device as defined in claim 34, wherein a housing cover is provided.

37. Clamping and spreading device as defined in claim 34, wherein movable parts for the displacement movement of said slide rail are insertable into said housing.

38. Clamping and spreading device as defined in claim 34, wherein a contact element for workpieces is connected to the housing.

39. Clamping and spreading device as defined in claim 1, wherein a contact element for workpieces is connected to the slide rail.

* * * * *